United States Patent [19]

Gray et al.

[11] 4,003,700

[45] Jan. 18, 1977

[54] CLEANING FABRICS

[75] Inventors: Frederick William Gray, Summit; Jon C. Jervert, Piscataway, both of N.J.

[73] Assignee: Colgate-Palmolive Company, New York, N.Y.

[22] Filed: Apr. 16, 1976

[21] Appl. No.: 677,653

Related U.S. Application Data

[63] Continuation of Ser. No. 447,712, March 4, 1974, which is a continuation of Ser. No. 138,372, April 28, 1971, abandoned.

[30] Foreign Application Priority Data

May 1, 1970 United Kingdom ..... 21080/70

[52] U.S. Cl. ..... 8/111; 252/95; 252/96; 252/97; 252/98; 252/99; 252/186

[51] Int. Cl.[2] ..... D06L 3/02

[58] Field of Search ..... 252/186, 102, 99, 95, 252/96, 97; 8/111

[56] References Cited

UNITED STATES PATENTS

| | | | |
|---|---|---|---|
| 3,630,921 | 12/1971 | Disch | 252/186 |
| 3,637,339 | 1/1972 | Gray | 252/186 |
| 3,714,050 | 1/1973 | Gray | 252/186 |
| 3,969,257 | 7/1976 | Murray | 252/95 |

*Primary Examiner*—Samuel W. Engle
*Assistant Examiner*—Ralph Palo
*Attorney, Agent, or Firm*—Herbert S. Sylvester; Murray M. Grill; Norman Blumenkopf

[57] ABSTRACT

In a process for removing stains from fabrics by washing in an aqueous medium containing a peroxygen compound and an acylamide activator, extremely small amounts of the activator, e.g., about 5 to 50 ppm., are effective if the medium contains about 100 to 300 ppm of trisodium nitrilotriacetate or ethylene diamine tetraacetic acid sodium salt and an amount of the peroxygen compound representing about 3 to 80 ppm of active oxygen and substantial excess of active oxygen over that stoichiometrically equivalent to the amount of activator.

26 Claims, No Drawings

CLEANING FABRICS

This is a continuation, of application Ser. No. 447,712 filed Mar. 4, 1974, which is a continuation of application Ser. No. 138,372 filed Apr. 28, 1971 and now abandoned.

This invention relates to combinations of peroxy compounds and organic activators for the cleaning of fabrics.

Combinations of peroxy compounds (such as sodium perborate and sodium percarbonate) with organic activators with or without organic detergents are well known in the art. The activators are generally esters (e.g., aromatic esters such as phenyl acetate, chloroacetyl salicyclic acid), amides (such as N-benzoyl succinimide, N,N,N'N'-tettracetyl-ethylenediamine or acyl azoles such as those disclosed in Canadian Pat. No. 844,481, e.g., N-benzoyl imidazole) or acid anhydrides (such as triacetyl cyanurate), which can form peracids on reaction with the peroxy compound.

The organic activators are relatively costly, being much more expensive than the peroxygen compound, and their use thus increases the cost of bleaching considerably; see, for instance, page 67 of the August 1967 issue of the periodical Detergent Age (part of a series of articles, starting on page 18 of the June 1967 issue of that periodical, describing various activators for sodium perborate). It has also been the experience of those skilled in the art that a decrease in the proportion of the organic activator results in a serious decrease in bleaching effectiveness. See for instance Example I of British Pat. No. 907,356 in which there was a substantial decline in bleaching effect when the amount of activator was reduced from a proportion supplying 2.5 acetyl groups per atom of available oxygen to a proportion supplying 0.63 acetyl group per atom of available oxygen. Similarly Example XV of that same British patent, shows that, at a given level of sodium perborate, there was a sharp decline in bleaching effect when the amount of activator was reduced from a proportion supplying 2.0 acetyl groups to a proportion supplying 1.5 acetyl groups per atom of available oxygen. A similar effect is shown in Example 5 of Swedish Pat. No. 68/17880 in which there was a very marked decline in bleaching, at 45° C, when the amount of the activator (tetraacetyl glycouril) was reduced from ¾ mol to ¼ mol per mol of perborate (that is, a reduction from 3 acetyl groups per atom of active oxygen to only 1 acetyl group per atom of active oxygen).

In accordance with one aspect of this invention it has been discovered that, by the inclusion of compounds such as nitrilotriacetic acid trisodium salt (NTA) or ethylenediaminetetraacetic acid sodium salt (EDTA) in the manner illustrated in the following Examples it is possible to obtain very effective bleaching using only very small amounts of the activator, such as only ⅛ mol of activator, or less, per mol of perborate. These results are clearly important, if only for the great saving in the cost of the expensive activator, and they are also quite surprising in the light of the teachings of the art.

In one particularly useful embodiment of the invention there is employed a dry finely divided solid mixture containing a phosphate builder salt, particularly pentasodium tripolyphosphate, in combination with the NTA or EDTA, together with the peroxygen compound and the relatively small amount of the activator.

In one aspect of the invention the amount of activator is such that the proportion of the activator in the wash water is less than about 90 parts per million (e.g. about 5 to 50 ppm), and the amount of peroxygen compound is such as to provide a considerable excess (such as a 50%, 100% 200%, 300% excess or even a 700% or greater excess) of active oxygen over that stoichiometrically equivalent to the amount of activator. With the very small amounts of activator used in the practice of this invention, the provision of excess peroxygen compound in the mixture is advantageous, especially in view of the known tendency for peroxygen compounds to lose activity on extended storage.

The amount of peroxygen compound is generally within range of amounts representing about 3 to 80 parts of active oxygen per million parts of wash solution, e.g., about 10 to 40 ppm of active oxygen, based on the weight of wash solution. The invention has thus far shown its greatest utility with amounts representing about 10 to 20 ppm of active oxygen. Thus, a perborate composition intended for addition at the rate of 1 gram per liter to the wash water suitably contains about 10 to 20% of sodium perborate tetrahydrate, whose active oxygen content is 10% so that the amount of sodium perborate added to the wash water represents about 10 to 20 ppm of active oxygen.

The activators which are preferred for use in this invention are of the amide type, well known in the art (and discussed in the patents and publications cited above), which have a monovalent carboxylic acyl group directly attached to a nitrogen atom and which as mentioned above, form peracids on reaction with the peroxy compound in solution. Especially suitable are compounds in which the acyl group is acetyl or benzoyl or substituted benzoyl. For tetraacetyl compounds such as tetraacetylglycoluril (which has four nitrogen atoms, each of which has one acetyl group directly attached thereto) and N,N,N',N'-tetraacetyl ethylenediamine (which has two nitrogen atoms, each of which has two acetyl groups directly attached thereto), the stoichiometric equivalence may be considered to be one mol of active oxygen per ¼ mol of the tetraacetyl compound; thus a 1:8 tetracetyl activator:perborate mol ratio corresponds to a 1:2 acetyl:active oxygen mol ratio. For activators in which there is only one nitrogen atom carrying a monovalent carboxylic acyl group, such as the ring-substituted or unsubstituted N-benzoyl dimethylhydantoins, the stoichiometric equivalence is one mol of active oxygen per mol of the activator.

The proportion of the NTA or EDTA is preferably such as to provide about 100 to 300 ppm of one or both of these compounds in the wash solution; for EDTA the amount may even be as low as 50 ppm although considerably better results are obtained with the larger proportions. Phosphates such as pentasodium tripolyphosphate (TPP) may also be present, preferably in amount less than about 500 ppm, e.g., 100, 200, 300 or 400 ppm. Better bleaching is obtained when the amount is at most about 300 ppm. In one preferred form of the invention the washing solution contains about 100 ppm of NTA and 100 ppm of TPP.

The washing solution should contain at least about 15 ppm, and preferably at least about 20 ppm, e.g., 20, 60 or 120 ppm of calcium ion. As will be seen in Example 12 below, the results described herein are (for reasons not now understood) generally not obtained in water free of calcium ions. In many of the suitable washing solutions the amount of calcium is equal to or greater than that sufficient to form a complex with all the NTA present.

The invention is especially useful in the long-term presoaking of fabrics. In such soaking, unlike washing in a machine, the fabrics (clothes) and wash solution are generally substantially quiescent, there being little or no agitation of the fabrics, and the temperature may be relatively low, e.g., below 110° F for much of the soak period. Often for most of the soak period (which extends for well over an hour), the temperature is well below 100° F, e.g., 60° F, 70° F or 80° F. The conditions in soaking are such that phosphate-containing soak solutions made with peroxygen compound and activator lose practically all their peracid content during prolonged soaking (e.g., overnight). The reasons for this effect are not understood but they may result from chemical reaction between the peroxygen compound and the peracid, especially when the peroxygen compound is present in excess of the stoichiometric amount needed. In contrast the wash solutions of this invention retain their peracid content for considerable periods of time and often show substantial contents of peracid (e.g., $0.5 \times 10^{-4}$ or $1 \times 10^{-4}$, or more, mol of peracid per liter) after standing 18 or 20 hours at say 70° or 80° F, as compared with a peracid content of say, about $3 \times 10^{-4}$ mol per liter within the first 15 minutes after the ingredients are dissolved to form the wash solution at 105° F. It will be understood that it is also within the broad scope of the invention to use soak solutions which are initially at relatively high temperatures, e.g., 160° F; such high temperature may, however, cause damage to some dyed fabrics and to some man-made fibers. The invention is also of considerable utility in the machine washing of fabrics in which the fabrics are subjected to the washing solutions for relatively short times (generally less than ½ hour and usually about 5 to 15 minutes, e.g., 10 minutes) at room temperature or at higher temperatures, such as about 120° F (about 50° C) or more; see Example 7, for instance.

Other ingredients may also be present in the composition. For instance proteolytic enzymes may be present, and in one preferred form, these are used together with some 200 to 300 ppm of phosphates, based on the weight of wash solution. Other ingredients are, for instance, the well known anionic or nonionic detergents and other components (e.g. antiredeposition agents such as sodium carboxymethylcellulose, optical brighteners, anti corrosion agents) commonly employed in detergent or bleaching compositions.

Typical anionic detergents are the alkylbenzenesulfonates having 10–16, e.g., 12, carbon atoms in the alkyl group particularly of the type described in U.S. Pat. No. 3,320,174, 16 May 1967 of J. Rubinfeld; the olefin sulfonates having 12 to 20, e.g. 16, carbon atoms particularly mixtures of alkenesulfonates and hydroxyalkanesulfonates obtained by reacting an alpha olefin with gaseous highly diluted $SO_3$ and hydrolyzing the resulting sultone-containing product, as by neutralizing with excess NaOH and heat treating to open the sultone ring; and the higher alkyl sulfates such as tallow alcohol sulfate. Most commonly these materials are employed as their sodium or other alkali metal salts, but ammonium or alkaline earth metal (e.g., magnesium salts) may be used. Mixtures of various anionic detergents, e.g., a mixture of a sodium alkylbenzenesulfonate and a sodium olefin sulfonate may be employed.

Other anionic detergents are water-soluble soaps which may be used, alone or in combination with other detergents. Examples of soaps are the sodium, potassium, etc., salts of fatty acids such as lauric, myristic, stearic, oleic, elaidic, isostearic, palmitic, undecylenic, tridecylenic, pentadecylenic or other saturated or unsaturated fatty acid of 11 to 18 carbon atoms. Soaps of dicarboxylic acids may also be used such as the soaps of dimerized linoleic acid. Soaps of such other higher molecular weight acids such as resin or tall oil acids, e.g., abietic acid, may also be employed. One specific suitable soap is the sodium soap of a mixture of tallow fatty acids and coconut oil fatty acids (e.g., in 3:1 ratio).

As indicated in the Examples, this invention makes possible relatively inexpensive and highly effective presoak compositions, which act at moderate temperatures (e.g., room temperature). It may also be employed in washing compositions (e.g., for use with agitation, as in automatic washing machines) at room temperature or at higher temperature, such as 120° F.

The reasons for the results obtained by this invention are not understood clearly. It may be that the NTA or EDTA reacts with the activator or peroxygen compound or both. In any event the results are in sharp contrast to those encountered when NTA is used to replace phosphates in conventional phosphate-built washing compositions containing sodium perborate, without organic activator; in the latter case the incorporation of the NTA has been observed to adversely affect the cleaning power of the composition.

The following Examples illustrate this invention further. In the application all proportions are by weight unless otherwise indicated.

EXAMPLE 1

Compositions are tested for their effectiveness in bleaching cloth, on overnight soaking. In each test one gram of the composition is dissolved in 1 liter of tap water at 105° F and three coffee-tea stained cotton fabric test swatches of predetermined reflectance (Rd) values are added. After allowing to stand overnight (18 hours) without agitation at room temperature (about 72° F), the swatches are ruined, dried and Rd values again recorded on a Gardner Color Difference Meter. The average Δ Rd value is then determined for the experiment. The following results are obtained for various compositions containing sodium perborate tetrahydrate ($NaBO_3 4H_2O$), pentasodium tripolyphosphate ("TPP"), nitrilotriacetic trisodium salt monohydrate ("NTA"), sodium sulfate and activator (in this case tetraacetylglycoluril) as indicated.

| | Perborate | Activator | TPP | NTA | $Na_2SO_4$ | Mol ratio, activator: perborate | Δ Rd. |
|---|---|---|---|---|---|---|---|
| a. | 0.10g | none | 0.60g | none | 0.300g | — | 4.0 |
| b. | 0.10g | none | none | 0.20g | 0.700g | — | 2.9 |
| c. | 0.10g | 0.10g | 0.60g | none | 0.20g | 1:2 | 8.8 |
| d. | 0.10g | 0.10g | none | 0.20g | 0.60g | 1:2 | 9.0 |
| e. | 0.10g | 0.025g | 0.60g | none | 0.275g | 1:8 | 4.6 |
| f. | 0.10g | 0.025g | none | 0.20g | 0.675g | 1:8 | 9.0 |
| g. | 0.10g | 0.012g | 0.60g | none | 0.288g | 1:16 | 4.2 |

-continued

| | Perborate | Activator | TPP | NTA | $Na_2SO_4$ | Mol ratio, activator: perborate | Δ Rd. |
|---|---|---|---|---|---|---|---|
| h. | 0.10g | 0.012g | none | 0.20g | 0.688g | 1:16 | 8.0 |
| i. | 0.10g | 0.006g | 0.60g | none | 0.294g | 1:32 | 3.9 |
| j. | 0.10g | 0.006g | none | 0.20g | 0.694g | 1:32 | 7.1 |
| k. | 0.20g | none | 0.60g | none | 0.200g | — | 5.4 |
| l. | 0.20g | none | none | 0.20g | 0.600g | — | 5.6 |
| m. | 0.20g | 0.05g | 0.60g | none | 0.15g | 1:8 | 5.8 |
| n. | 0.20g | 0.05g | none | 0.20g | 0.55g | 1:8 | 9.9 |
| o. | 0.20g | 0.025g | 0.60 | none | 0.175g | 1:16 | 6.1 |
| p. | 0.20g | 0.025g | none | 0.20g | 0.575g | 1:16 | 9.3 |
| q. | 0.20g | 0.012g | 0.60g | none | 0.188g | 1:32 | 6.4 |
| r. | 0.20g | 0.012g | none | 0.20g | 0.588g | 1:32 | 9.0 |

EXAMPLE 2

Example 1 is repeated except that the soak period is shortened from overnight (18 hours) to 0.5 and 1 hour periods. The formulations and results are tabulated below:

| | Perborate | Activator | TPP | NTA | $Na_2SO_4$ | Mol Ratio | Δ Rd 0.5 hr | Δ Rd 1.0 hr |
|---|---|---|---|---|---|---|---|---|
| a. | 0.20g | 0.05g | 0.20g | none | 0.55g | 1:8 | 2.7 | 4.4 |
| b. | 0.20g | 0.05g | none | 0.20g | 0.55g | 1:8 | 4.1 | 5.5 |
| c. | 0.10g | 0.025g | none | 0.20g | 0.675g | 1:8 | 3.2 | 4.3 |
| d. | 0.30g | 0.075g | none | 0.20g | 0.425g | 1:8 | 4.8 | 6.1 |

EXAMPLE 3

Example 1 is repeated, using (in some cases) sodium percarbonate ($2Na_2CO_3$-$3H_2O$, 12.5% active oxygen) and including anhydrous $MgSO_4$ (which is believed to help stabilize the compositions against aging) in the compositions. The compositions (which are mixtures of powders of the ingredients) are also tested after they have been aged at 120° F in sealed glass vials for 2 weeks prior to the soaking test. The formulations and results are given below:

| | Perborate | Percarbonate | Activator | NTA | $Na_2SO_4$ | $MgSO_4$ | Aged | Δ Rd |
|---|---|---|---|---|---|---|---|---|
| a. | 0.20g | none | 0.05g | 0.20g | 0.45g | 0.10g | no | 12.4 |
| b. | 0.20g | none | 0.05g | 0.20g | 0.45g | 0.10g | yes | 12.1 |
| c. | none | 0.16g | 0.05g | 0.20g | 0.49g | 0.10g | no | 12.6 |
| d. | none | 0.16g | 0.05g | 0.20g | 0.49g | 0.10g | yes | 12.4 |

In each case the mol ratio of activator:active oxygen is 1:8.

EXAMPLE 4 a. Example 1 is repeated with compositions containing 0.100g of spray dried detergent particles (of the following constitution: 60% sodium linear dodecylbenzenesulfonate, 7.5% sodium silicate [of 1:2.35 $Na_2O$:-$SiO_2$ ratio], about 1.3% $H_2O$ and the balance sodium sulfate, with a small amount of phenolic antioxidant) 0.06g of $MgSO_4$, 0.10g of the sodium perborate, 0.025g of the activator (so that the mol ratio is 1:8), NTA or TPP, or both, in varying amounts, and enough sodium sulfate to make the total weight of the composition 1.00 g. When the compositions contain 0.20g of NTA, either without TPP or with amounts of 0.10g, 0.20g, 0.30g or 0.40g of TPP (and with, or without, the spray dried detergent) the Δ Rd values are in the range of 8.1 to 9.3. When the composition contains 0.20g TPP but no NTA the Δ Rd value is 5.4.

b. Example 4a is repeated, except that the amount of $MgSO_4$ is 0.10g, the amount of the sodium perborate is 0.20g and the amount of the activator is 0.050g (so that the mol ratio remains at 1:8). When the compositions contain 0.20g of NTA, either without TPP or with amounts of 0.10g, 0.20g, 0.30g or 0.40 g of TPP (and with, or without, the spray dried detergent) the Δ Rd values are in the range of 9.5 to 10.6. When the composition contains 0.20g TPP but no NTA the Δ Rd value is 7.8.

EXAMPLE 5

Example 1 is repeated, using N,N,N′,N′-tetraacetylethylene diamine as the activator and using TPP or NTA or ethylenediamine tetraacetic acid tetrasodium salt dihydrae (EDTA) in the composition, as indicated. The composition and results are tabulated below:

| Perborate | Activator | TPP | $Na_2SO_4$ | pH at end of soak | Mol ratio Activator: Perborate: | Δ Rd |
|---|---|---|---|---|---|---|
| 0.20g | 0.037g | 0.60g | 0.163g | 9.3 | 1:8 | 6.7 |
| 0.20g | 0.019g | 0.60g | 0.181g | 9.4 | 1:16 | 6.7 |
| 0.20g | 0.009g | 0.60g | 0.191g | 9.5 | 1:32 | 6.7 |
| 0.20g | none | 0.60g | 0.20g | 9.5 | — | 6.1 |

-continued

| | | | | | | |
|---|---|---|---|---|---|---|
| | | NTA | | | | |
| 0.20g | 0.037g | 0.20g | 0.563g | 9.2 | 1:8 | 9.0 |
| 0.20g | 0.019g | 0.20g | 0.581g | 9.3 | 1:16 | 8.5 |
| 0.20g | 0.009g | 0.20g | 0.591g | 9.4 | 1:32 | 7.7 |
| 0.20g | none | 0.20g | 0.600g | 9.5 | — | 5.4 |
| | | EDTA | | | | |
| 0.20g | 0.037g | 0.20g | 0.563g | 8.9 | 1:8 | 10.6 |
| 0.20g | 0.019g | 0.20g | 0.581g | 9.1 | 1:16 | 9.6 |
| 0.20g | 0.009g | 0.20g | 0.591g | 9.3 | 1:32 | 7.6 |
| 0.20g | none | 0.20g | 0.600g | 9.4 | — | 4.6 |

EXAMPLE 6

Example 1 is repeated; using TPP or EDTA in the composition, as indicated. The compositions and results are tabulated below:

| Perborate | Activator | TPP | EDTA | $Na_2SO_4$ | Mol ratio Activator: Perborate | Δ Rd |
|---|---|---|---|---|---|---|
| 0.20g | 0.05g | 0.60g | none | 0.159 | 1:8 | 6.1 |
| 0.20g | 0.05g | none | 0.20g | 0.55g | 1:8 | 10.1 |
| 0.20g | 0.025g | 0.60g | none | 0.175g | 1:16 | 5.9 |
| 0.20g | 0.025g | none | 0.20g | 0.575g | 1:16 | 9.0 |
| 0.20g | 0.013g | 0.60g | none | 0.187g | 1:32 | 5.8 |
| 0.20g | 0.013g | none | 0.20g | 0.587g | 1:32 | 8.0 |
| 0.20g | none | 0.60g | none | 0.20g | — | 6.6 |
| 0.20g | none | none | 0.20g | 0.60g | — | 6.2 |

EXAMPLE 7

Four compositions are prepared, each containing 20% sodium perborate tetrahydrate and enough sodium sulfate to make 100%, one (A) contains 5% activator and 20% NTA, the second (B) contains 5% activator and 60% TPP, the third (C) contains 5% activator and no TPP or NTA, and the fourth (D) contains neither activator, TPP nor NTA. The 5% activator (tetraacetyl glycoluril) is present at a mol ratio of activator: perborate of 1:8.

One gram of each of these compositions is placed in 1 liter of water at a temperature of 120° F and placed along with three 3 × 6 inch coffee-tea stained cotton fabric swatches in a vessel (a Tergotometer), with or without agitation, as indicated, for short periods of time(during which the temperature is maintained at 120° F). The results, in terms of Δ Rd of the cloth after rinsing and drying, are tabulated below.

| | Δ Rd | | | |
|---|---|---|---|---|
| | B Activator plus TPP | A Activator plus NTA | C Activator | D No Activator |
| 10 minutes without agitation | 2.5 | 4.5 | 2.7 | −0.2 |
| 10 minutes with agitation at 100 RPM | 2.1 | 4.3 | 3.1 | 0.2 |
| 10 minutes without agitation followed by 10 minutes with agitation at 100 RPM | 3.2 | 6.5 | 5.3 | 2.1 |

EXAMPLE 8

This Example compares two compositions, with and without the activator of Example 1 (in 1:8 mol ratio), with respect to the results obtained on presoaking soiled clothes and then washing in conventional manner with a commercial low-foaming built detergent. In the test 65 grams of the composition to be tested is added to an automatic washing machine filled with 17 gallons of water at 105° F and an 8 pound load of clothes. Included in each load is an equal number of cotton and cotton-Dacron fabrics which had been similarly stained with tea, coffee, ink, grass, beets, beef liver blood, grape juice concentrate, head soil and a coffee-tea blend. After soaking the load overnight (18 hours) the soak water is removed, the machine is refilled with 120° F water, 100g of the commercial built detergent is added and a standard wash cycle is carried out, after which the load is dried.

The two compositions are as follows:

| | A | B |
|---|---|---|
| Sodium perborate tetrahydrate | 13.0g | 13.0g |
| Activator | — | 3.3g |
| TPP | 13.0g | 13.0g |
| NTA | 13.0g | 13.0g |
| Spray-dried detergent (described in Example 4) | 6.5g | 6.5g |
| Magnesium sulfate | 6.5g | 6.5g |
| Sodium sulfate | 13.0g | 9.7g |
| Total: | 65.0g | 65.0g |

For all cases stain removal is found on visual inspection to be greater than composition B than with composition A.

EXAMPLE 9

Example 8 is repeated except that 0.5g of a powdered proteolytic subtilisin enzyme preparation (Alcalase having an enzyme assay of 1.5 Anson units per gram) is substituted for 0.5g of the $Na_2SO_4$, with similar results.

EXAMPLE 10

Another presoak composition contains 20% sodium perborate tetrahydrate, 5% tetraacetylglycoluril, 20% TPP, 20% NTA, 0.8% of the enzyme preparation of Example 9 and the balance sodium sulfate.

EXAMPLE 11

I. Example 1 is repeated, using as the activator the compound m-chlorobenzoyl 5,5-dimethylhydantoin, described in French Pat. No. 1,590,335, in the following proportions:

| | Perborate (g.) | Activator (g.) | TPP (g.) | NTA (g.) | $Na_2SO_4$ (g.) | Mol ratio activator: perborate | Δ Rd |
|---|---|---|---|---|---|---|---|
| a. | 0.10 | none | 0.60 | none | 0.300 | — | 4.2 |
| b. | 0.10 | none | none | 0.20 | 0.700 | — | 3.3 |
| c. | 0.10 | (174 ppm) 0.174 | 0.60 | none | 0.126 | 1:1 | 9.7 |
| d. | 0.10 | 0.174 | none | 0.20 | 0.526 | 1:1 | 10.3 |
| e. | 0.10 | (87 ppm) 0.087 | 0.60 | none | 0.213 | 1:2 | 6.5 |
| f. | 0.10 | 0.087 | none | 0.20 | 0.613 | 1:2 | 9.8 |
| g. | 0.10 | (43.5 ppm) 0.0435 | 0.60 | none | 0.256 | 1:4 | 5.3 |
| h. | 0.10 | 0.0435 | none | 0.20 | 0.656 | 1:4 | 8.6 |
| i. | 0.10 | (21.8 ppm) 0.0218 | 0.60 | none | 0.278 | 1:8 | 4.1 |
| j. | 0.10 | 0.0218 | none | 0.20 | 0.678 | 1:8 | 7.8 |
| k. | 0.10 | (10.9 ppm) 0.0109 | 0.60 | none | 0.289 | 1:16 | 4.0 |
| l. | 0.10 | 0.0109 | none | 0.20 | 0.689 | 1:16 | 6.1 |

(II), (III) Example 11 (I) is repeated except that in place of the m-chlorobenzoyl dimethylhydantoin there is substituted, mol for mol, (II) N-acetyl 2-methylimidazole or (III) N-benzoyl 2-methylimidazole; produced by acylating the 2-methylimidazole with ketene and benzoyl chloride, respectively.

EXAMPLE 12

Example 1 is repeated, using tetraacetylglycoluril as the activator, at a mol ratio of about 1:8(activator: peroxygen compound). In this case instead of using New Brunswick tap water, the compositions are dissolved in either (I) distilled water or (II) distilled water to which calcium chloride has been added in amount sufficient to provide a calcium hardness of 100 ppm calculated as calcium carbonate (i.e., a Ca ion content of 40 ppm). The formulations and the results are given below.

| Peroxygen Compound Sodium perborate | Activator | TPP | NTA | $Na_2SO_4$ | Δ Rd I Distilled Water | Δ Rd II Distilled Water + Ca ions | pH at end of soak I Distilled Water | pH at end of soak II Distilled Water plus Ca ions |
|---|---|---|---|---|---|---|---|---|
| a. 0.20g | 0.05g (50 ppm) | 0.6g | none | 0.15g | 6.6 | 6.3 | 9.1 | 9.0 |
| b. 0.20g Sodium percarbonate | 0.05g | none | 0.2g | 0.55g | 6.7 | 8.5 | 9.0 | 8.9 |
| c. 0.15g | 0.05g | 0.6g | none | 0.20g | 6.8 | 6.1 | 9.3 | 9.1 |
| d. 0.15g | 0.05g | none | 0.2g | 0.60g | 7.0 | 8.8 | 9.3 | 9.0 |

At the end of each soak the soak solution is analyzed for its total active oxygen content and its peracid content. The following results are obtained:

| | Total active oxygen (mols × $10^4$/liter) I Distilled water | Total active oxygen (mols × $10^4$/liter) II Water with Ca | Peracid (mols × $10^4$/liter) I Distilled Water | Peracid (mols × $10^4$/liter) II Water with Ca |
|---|---|---|---|---|
| a. (Perborate + TPP + activator) | Above 2, in each case | | 0.0 | 0.0 |
| b. (Perborate + NTA + activator | | | 0.0 | 1.0 |
| c. (Percarbonate + TPP + activator | | | 0.0 | 0.0 |
| d. (Percarbonate + NTA + activator | | | 0.0 | 1.0 |

The analyses for total active oxygen and active oxygen as peracid are carried out in conventional manner. For the total active oxygen analysis an aliquot portion of the solution of the composition being tested is acidified with 1N sulfuric acid, treated with potassium iodide along with a small amount of ammonium molybdate and titrated with standardized sodium thiosulfate using starch as indicator. For the peracid analysis another aliquot portion of the solution being tested is poured onto cracked ice, acidified with glacial acetic acid and potassium iodide added. The ice-cold solution is titrated with standardized sodium thiosulfate until the first disappearance of blue color from the starch indicator.

EXAMPLE 13

Example 1 is repeated with compositions each containing 0.20g of the sodium perborate, 0.05g of the tetraacetylglycoluril (so that the mol ratio is 1:8 and the activator concentration in the soak solution is 50 ppm), 0.10g of the spray dried detergent particles of Example 4, EDTA and TPP in the amounts given below, and sufficient sodium sulfate to bring the total weight of each composition to 1.0g. The following results are obtained:

| | EDTA | TPP | Activator | Δ Rd |
|---|---|---|---|---|
| a. | 0.2g | 0.6g | 0.05g | 8.1 |
| b. | 0.2g | 0.4g | 0.05g | 8.2 |
| c. | 0.1g | 0.6g | 0.05g | 8.2 |
| d. | 0.1g | 0.4g | 0.05g | 8.1 |
| e. | 0.05g | 0.6g | 0.05g | 6.8 |
| f. | 0.05g | 0.4g | 0.05g | 7.2 |
| g. | none | 0.6g | none | 4.7 |
| h. | none | 0.4g | none | 4.8 |
| i. | none | 0.4g | 0.05g | 5.6 |

EXAMPLE 14

Example 1 is repeated using compositions each containing 0.20g of the sodium perborate, 0.05g of the tetraacetylglycoluril (so that the mol ratio is 1:8 and the activator concentration in the soak solution is 50 ppm), NTA and/or TPP in the amounts given below, and sufficient sodium sulfate to bring the total weight of each composition to 1.0g. The following results are obtained:

| NTA | TPP | Δ Rd |
|---|---|---|
| none | 0.2g | 5.7 |
| 0.1g | 0.1g | 8.6 |
| 0.2g | none | 8.2 |

The water used in Examples 1 to 11, 13 and 14 is New Brunswick tap water having a hardness of about 100 ppm and a copper content of less than 1 ppm. A typical chemical analysis of the water supply is as follows, all figures (except pH) being in parts per million, unless otherwise indicated: total hardness 90, alkalinity 38, $CO_2$8, pH 7.6,chlorine 1.0, iron 0.05, manganese 0.00, consumed oxygen 0.6, dissolved oxygen 15.0, chlorides 25, total solids 165, organic and volatile 40, mineral matter 125, free ammonia 0.048, albumoid ammonia 0.015, nitrates as nitrogen 0.00, nitrates as nitrogen 0.20. A typical mineral analysis of this water supply (with figures again in ppm) is : sulfates 45, silica 15, calcium 23.2, magnesium 7.776. As is conventional in the art, water hardness is expressed in terms of calcium carbonate; thus, the 23.2 ppm of calcium represents a hardness of 58 ppm of $CaCO_3$ (i.e., 23.2 × (100/40) and the 7.776 ppm of magnesium represents a hardness of 32 ppm of $CaCO_3$(i.e., 7.776 × (100/24), which adds up to the 90 ppm total hardness, expressed as $CaCO_3$. (In the foregoing calculations given in parenthesis it will be understood that 100 is the molecular weight of calcium carbonate, 40 is the atomic weight of calcium and 24 is the atomic weight of magnesium).

It is within the broader scope of the invention to use other forms of sodium perborate, e.g., sodium perborate monohydrate, or other activatable peroxy compounds; such compounds are well known in the art.

We claim:

1. Process for the removal of stains from fabrics which comprises forming an aqueous wash medium by dispersing in water a mixture consisting essentially of a peroxygen compound, an activator for said peroxygen compound which activator has carboxylic acyl amide groups and which activator reacts with said peroxygen compound to form a percarboxylic acid, a salt of an aminopolycarboxylic acid selected from the group consisting of trisodium nitrilotriacetate and ethylene diamine tetraacetic acid sodium salt, the proportions being such as to supply to said water about 5 to 50 ppm of said activator, an amount of peroxygen compound within the range representing about 3 to 80 ppm of active oxygen and substantial excess of active oxygen over that stoichiometrically equivalent to the amount of activator, and about 100 to 300 ppm of said aminopolycarboxylic acid salt, and maintaining said wash medium in contact with stained fabric immersed therein for a period of time sufficient to effect bleaching of said fabric.

2. Process as in claim 1 in which the amount of peroxygen compound represents about 10 to 20 ppm of active oxygen in said water and an at least 50% excess of active oxygen over that stoichiometrically equivalent to the amount of activator, said peroxygen compound is selected from the group consisting of sodium perborate, and sodium percarbonate and said time is at least about 5 minutes.

3. Process as in claim 2 in which said fabric is soaked in said solution for a period of over one hour without substantial agitation at a temperature below 110° F.

4. Process as in claim 2 in which said fabric is agitated in said solution for a period of 5 to 30 minutes and then rinsed.

5. Process as in claim 1 in which said mixture contains sodium tripolyphosphate in amount to provide less than 500 ppm thereof in the water.

6. Process as in claim 2 in which said mixture contains sodium tripolyphosphate in amount to provide about 100 to 300 ppm thereof in the water.

7. Process as in claim 3 in which said mixture contains a proteolytic enzyme in amount to provide about 0.001 to 0.1 Anson units per liter of the water.

8. Process as in claim 2 in which said solution contains at least 15 ppm of calcium.

9. Process as in claim 2 in which said activator contains four acetyl groups directly attached to nitrogen.

10. Process as in clam 9 in which said activator is tetraacetyl ethylenediamine.

11. Process as in claim 9 in which said activator is tetraacetylglycoluril.

12. Process as in claim 2 in which said activator contains an aroyl group attached to nitrogen.

13. Process as in claim 12 in which said activator is m-chlorobenzoyldimethylhydantoin.

14. Process as in claim 1 employing no more than about ⅛ mol of said activator per mol of said peroxygen compound.

15. Process as in claim 1 in which said peroxygen compound is sodium perborate.

16. Process as in claim 15 in which said activator is tetraacetylglycoluril.

17. Process as in claim 1 in which said activator is tetraacetylglycoluril.

18. Process as in claim 1 in which said aminopolycarboxylic acid salt is trisodium nitrilotriacetate.

19. Process as in claim 2 in which said aminopolycarboxylic acid salt is trisodium nitrilotriacetate.

20. Process as in claim 5 in which said aminopolycarboxylic acid salt is trisodium nitrilotriacetate.

21. Process as in claim 7 in which said aminopolycarboxylic acid salt is trisodium nitrilotriacetate.

22. Process as in claim 8 in which said aminopolycarboxylic acid salt is trisodium nitrilotriacetate.

23. Process as in claim 9 in which said aminopolycarboxylic acid salt is trisodium nitrilotriacetate.

24. Process as in claim 14 in which said aminopolycarboxylic acid salt is trisodium nitrilotriacetate.

25. Process as in claim 15 in which said aminopolycarboxylic acid salt is trisodium nitrilotriacetate.

26. Process as in claim 17 in which said aminopolycarboxylic acid salt is trisodium nitrilotriacetate.

* * * * *